US007673879B2

(12) United States Patent
Collings

(10) Patent No.: US 7,673,879 B2
(45) Date of Patent: Mar. 9, 2010

(54) ARM SUPPORT FOR A GAMING MACHINE

(76) Inventor: James Collings, 28 Colonial La., Harahan, LA (US) 70123

( * ) Notice: Subject to any disclaimer, the term of this patent is extended or adjusted under 35 U.S.C. 154(b) by 805 days.

(21) Appl. No.: 11/453,696

(22) Filed: Jun. 15, 2006

(65) Prior Publication Data

US 2007/0290437 A1 Dec. 20, 2007

(51) Int. Cl.
*A63F 11/00* (2006.01)

(52) U.S. Cl. ..... 273/148 R; 273/148 B; 463/47

(58) Field of Classification Search ..... 273/148 R, 273/148 B; 463/47; 248/118, 918
See application file for complete search history.

(56) References Cited

U.S. PATENT DOCUMENTS 3,837,720 A * 9/1974 Boris et al. ..... 312/198
5,046,739 A * 9/1991 Reichow ..... 273/148 B
5,170,971 A * 12/1992 Schaeffer et al. ..... 248/118.1
5,374,018 A * 12/1994 Daneshvar ..... 248/118
5,756,184 A * 5/1998 Yates ..... 428/188
6,347,796 B1 * 2/2002 Grossman et al. ..... 273/148 B
6,385,037 B2 * 5/2002 Howell et al. ..... 361/679.55
6,530,570 B2 * 3/2003 Ku ..... 273/148 B
6,886,896 B2 * 5/2005 Hedrick et al. ..... 312/223.1
6,932,341 B1 * 8/2005 Kenyon ..... 273/148 B
7,063,321 B2 * 6/2006 Hussaini et al. ..... 273/148 B
2004/0012146 A1 * 1/2004 Luciano et al. ..... 273/148 R
2005/0253811 A1 * 11/2005 Hiromori ..... 345/163
2006/0199648 A1 * 9/2006 Mitchell et al. ..... 463/46
2007/0114341 A1 * 5/2007 Raftery ..... 248/118
2007/0290437 A1 * 12/2007 Collings ..... 273/148 B

* cited by examiner

*Primary Examiner*—Raleigh W. Chiu
(74) *Attorney, Agent, or Firm*—Keaty Law Firm

(57) ABSTRACT

An arm support mountable onto a video machine housing has a first portion configured for resting on a console of the video game machine without blocking the machine's interactive controls. An optional second portion is unitary connected to the first portion and extends downwardly therefrom, partially extending along the front of the machine. The contact surfaces of the support are soft and pliant, allowing reduction of stress on the user's hands, wrists and arms. An optional food support tray is secured to the first portion and provides support for auxiliary items within easy reach of the user.

9 Claims, 3 Drawing Sheets

ARM SUPPORT FOR A GAMING MACHINE

BACKGROUND OF THE INVENTION

The present invention relates to an accessory for a video game, a gaming machine or an arcade video game machine that is designed to be detachably positioned on a console of the video game machine.

Video game machines increase in popularity every year. In addition to the traditional arcade game machines, the gambling industry has developed a multitude of machines for playing the games of chance (such as slot machines, video poker and the like). While playing a gaming machine a user may sit or stand in front of the machine. The user plays by and inserting coins, currency bills or other forms of credit, and manipulating one or more controls located in the gaming machine.

Players may spend hours playing a game, much like persons typing at a computer keyboard. The same symptoms of tiredness in the wrist accompany long hours of playing game machine. The gaming machines are not equipped to provide different levels of control locations for different size individuals or persons with disabilities. As a result, many players find that long hours of pushing the controls on a gaming machine or a video game machine cause stress and discomfort in the wrist, resulting in symptoms not unlike carpal tunnel syndrome that afflicts many computer users.

There exists, therefore, a need for an arm or wrist support accessory that can be detachably positioned on the console of a video game machine or slot machine to provide comfortable support for the user's arm.

SUMMARY OF THE INVENTION

It is, therefore, an object of the present invention to provide an armrest for use with a video or slot machine.

It is another object of the present invention to provide an armrest that can be detachably mounted on the game machine console.

It is another object of the present invention to provide an arm and wrist support pad that is deformable to accommodate different pressure exerted on the pad by the user.

These and other objects of the invention are achieved through a provision of an arm support device mountable onto a video machine housing. The support device has a first portion configured for resting on a console of the video game machine without blocking the machine's interactive controls. An optional second portion is unitary connected to the first portion and extends downwardly therefrom, partially extending along the front of the machine. The first portion has an upper surface formed from a soft, pliant material. A peripheral lip extends about the upper surface.

The second portion has a front surface formed from a soft pliant material. A peripheral lip extends about the front surface. The peripheral lips of the first portion and the second portion are secured together along a connecting line, which may be a hinge line. The pliant upper surface and the pliant front surface deform according to the weight rested on them by the user, allowing reduction of stress on the user's hands, wrists and arms. An optional food support tray is secured to the first portion and provides support for auxiliary items within easy reach of the user.

BRIEF DESCRIPTION OF THE DRAWINGS

Reference will not be made to the drawings, wherein like parts are designated by like numerals, and wherein.

DETAILED DESCRIPTION OF THE PREFERRED EMBODIMENT

Figure 1:
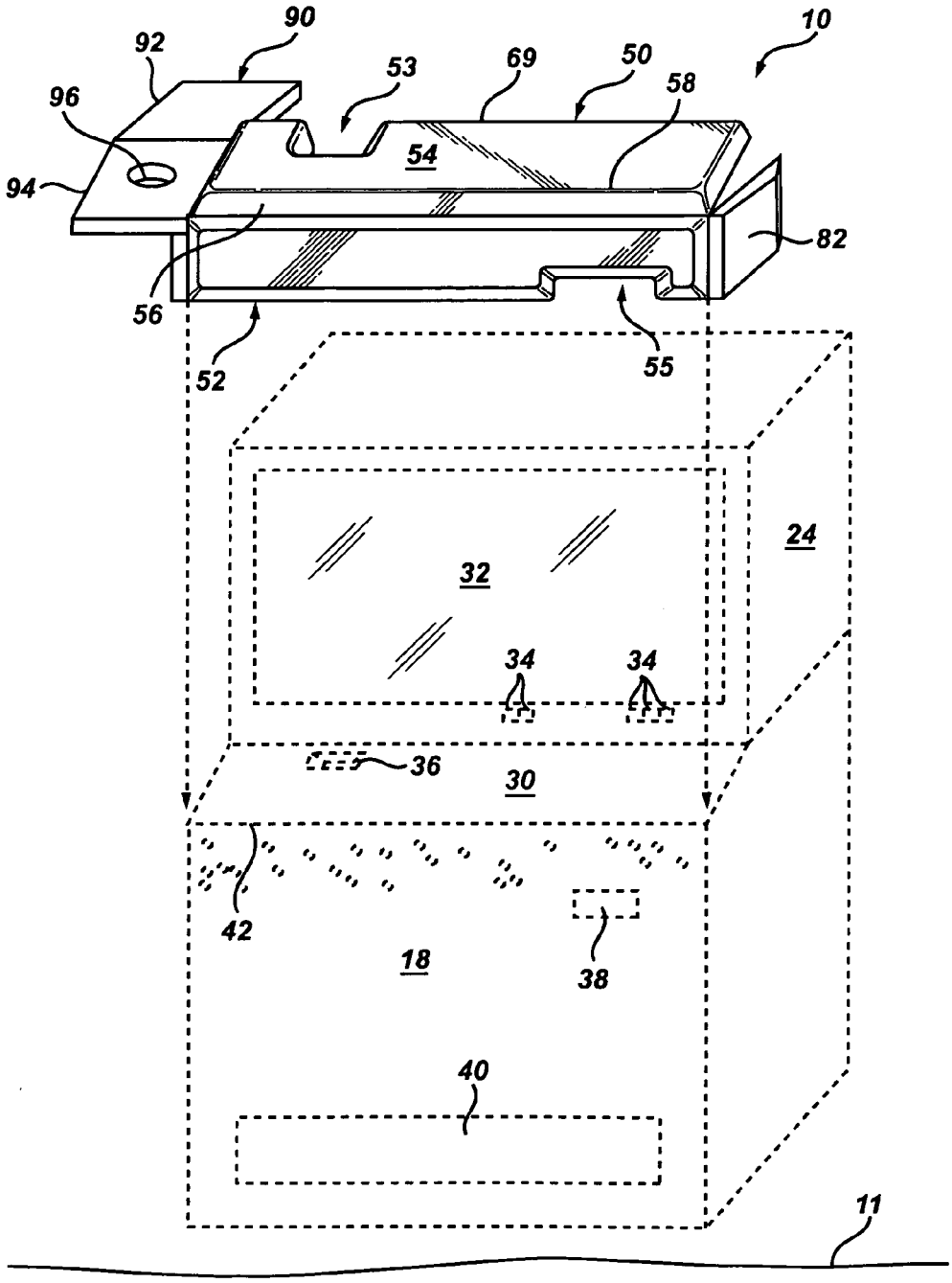
FIG. 1 is a perspective view of the arm in accordance with the present invention.

Turning now to the drawings in more detail, numeral 10 designates the armrest device in accordance with the present invention. The device 10 is adapted for detachable positioning on a console of a gaming machine 12, which is shown in phantom lines in the drawings. The gaming machine is adapted to rest on a support surface 11, such as a floor of a video arcade or a gaming hall. The gaming machine 12 has an upper front wall 14 opposite an upper back wall 16, a lower front wall 18 opposite a lower back wall 20 and two opposing sides 22, 24 extending between the upper and lower front walls 14, 18 and upper and lower back walls 18, 20. A console 30 extends between the upper front wall 12 and the lower front wall 18. In some gaming machines the console 30 may be inclined forwardly.

The front wall 12 encloses a screen 32 that allows the user to watch the visual images on the screen. A lower portion of the tipper front wall 12 provides a user interface buttons 34 for selective manipulation by the user. The console 30 may have a coin input 36, while the lower front wall 18 may have a currency receptacle 38 and a coin dispenser 40, where the player's winnings are deposited. The game player can insert coins into the coin input 36, view the screen, or gaming display 32, and operate control buttons 34 during the game.

The device 10 is configured to rest on the console 30. The device 10 is made from soft, deformable material, suitable for absorbing shock of repetitive hand movements of the player. Alternatively, the device 10 may be made of a solid, non-deformable inner layer and a deformable outer layer that covers the solid inner layer. The device 10 comprises an upper portion 50 and an optional downwardly extending portion 52, which may hinge in relation to the upper portion 50, if desired. The upper portion 50 has a planar upper surface 54, which forms support for the user's arms and wrists.

The upper portion 50 is sized and shaped to substantially cover the console 30 in the areas, where the user is expected to rest his arms and hands. The downwardly extending portion 52 is sized and shaped to cover the areas of the machine 12, which the user is expected to contact with his elbows or wrists, depending on the movement. A cutout 53 is formed in the upper portion 50 to accommodate the coin input 36. A cutout 55 is formed in the downwardly extending portion 52 to accommodate the currency receptacle 38.

A forward lip 56 extends along a front edge 58 of the planar upper surface 54; the lip 58 is unitary connected to the upper portion 50. Opposing end lips 60, 62 extend along end edges 64, 66 of the upper portion 50, and a distant lip 68 extends along an edge 69 of the upper surface 54. The lips 56, 60, 62, and 68 are unitary connected to the upper portion 50. The lips 56, 60, 62 and 68 may be formed as a single peripheral lip extending about the peripheral edges of the upper surface 54. The lips 56, 60, 62 and 68 may be inclined in relation to the surface 54, or formed at a right angle, if desired. In cross-section, the upper portion 50 can have a rectangular shape or that of a parallelogram.

The downwardly extending portion 52 comprises a planar front surface 70, an upper lip 72, a pair of opposing end lips 74, 76 and a bottom lip 78. The lip 72 is unitary connected to the forward lip 56 of the upper portion 50; the line of connection between the lips 56 and 72 may form a hinge line. The connection line between the lips 56 and 72 substantially covers a sharp edge 42 of the gaming machine 12, providing a soft contact surface for the user's arms.

The lips 72, 74, 76 and 78 may be formed as a continuous peripheral lip extending about the periphery of the planar surface 70. The lips 72, 74, 76 and 78 may be inclined in relation to the surface 70, or formed at a right angle, if desired. In cross-section, the downwardly extending portion 52 can have a rectangular shape or that of a parallelogram.

A pair of opposing planar securing members 80, 82 is secured to the opposing lips 74, 76, respectively, of the downwardly extending portion 52. The securing members 80, 82 are configured to snap onto the end walls 22, 24 of the machine 12 and facilitate secure positioning of the device 10 on the machine 12. The securing member 80, 82 extend transversely to the plane of the front surface 70 and in a substantially parallel relationship to the sidewalls 22, 24 of the video game machine 12.

Figure 2:
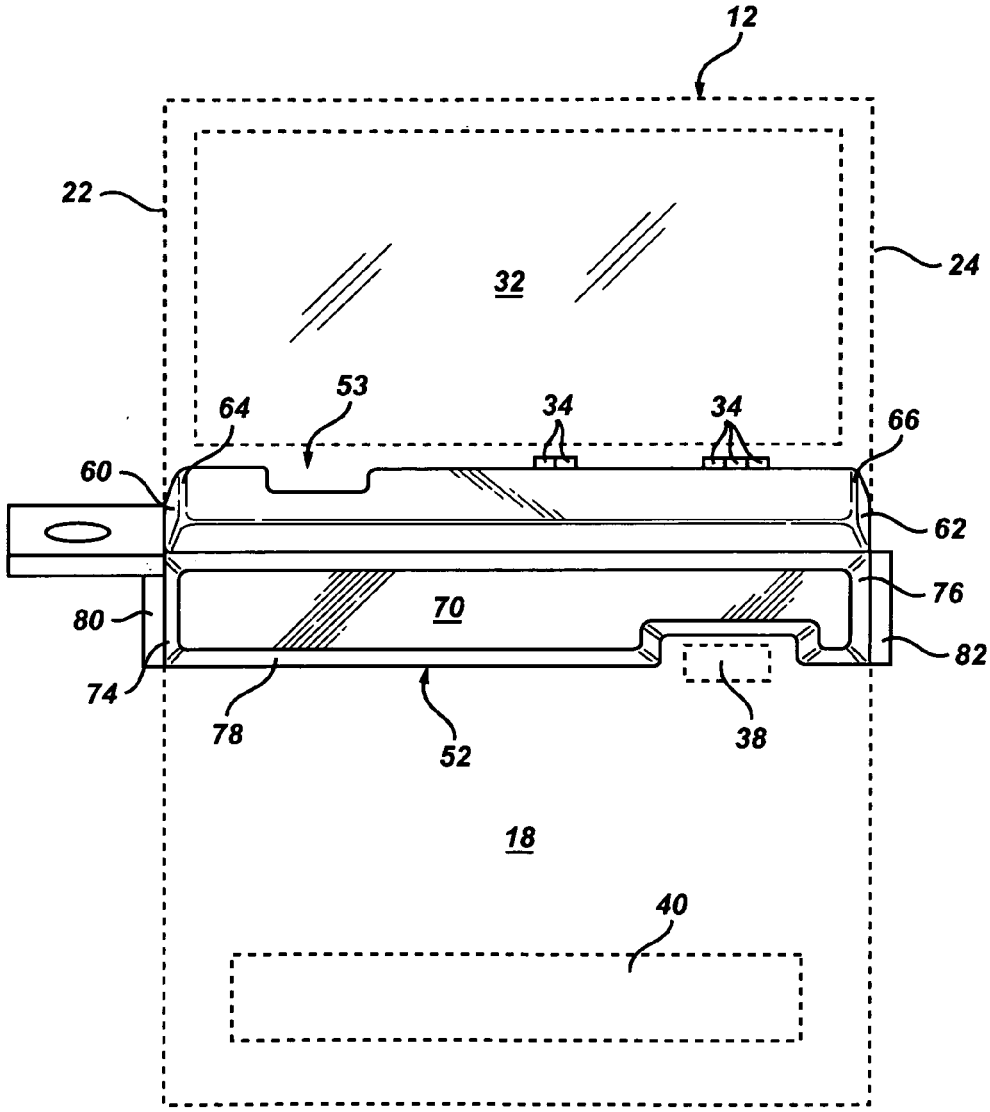
FIG. 2 is a front view of the arm support of the present invention.
Figure 3:
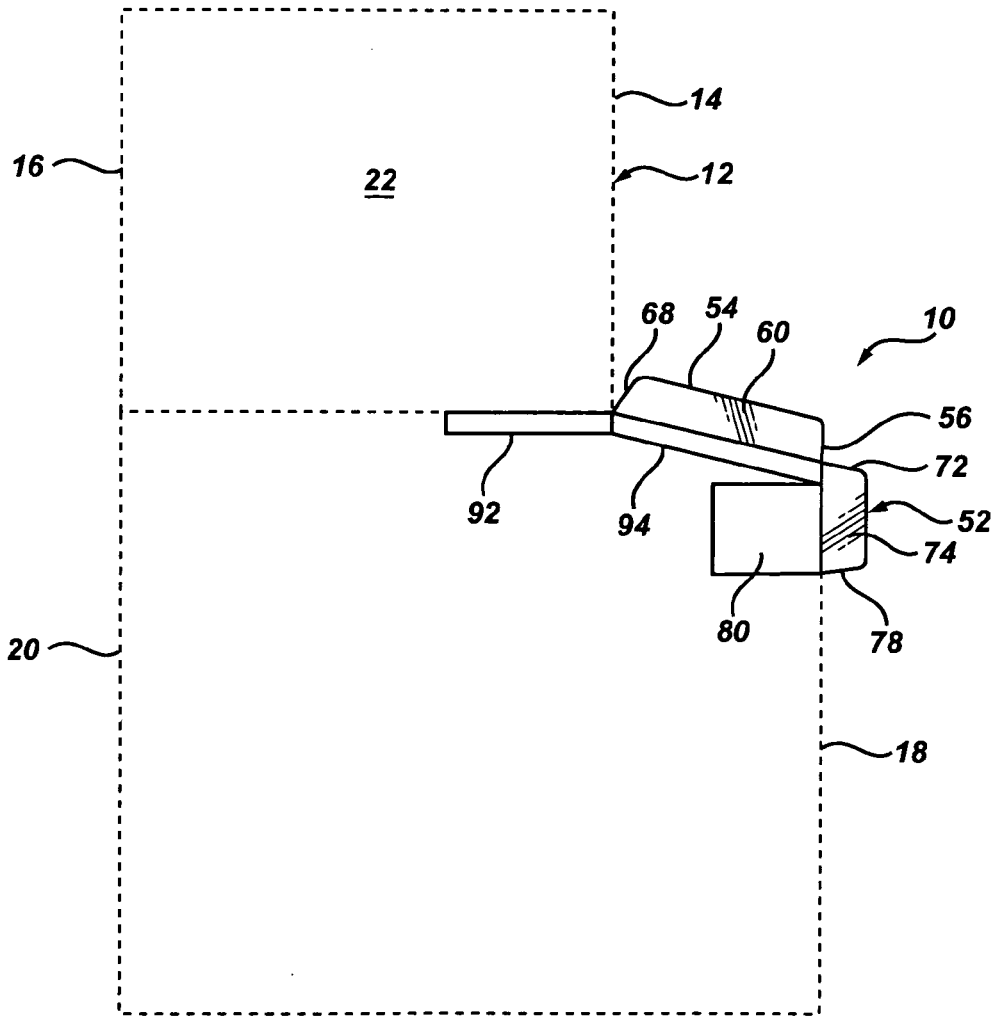
FIG. 3 is a side view of the arm support of the present invention.

A cup holder/food tray 90 is secured to the upper portion 50 and extends outwardly therefrom. The cup holder 90 may be secured in a known manner, such as by adhesive or strips of hook-and-loop fasteners. The cup holder 90 comprises a first planar portion 92 and a second planar portion 94. The second planar portion 94 is securely attached to the lip 60, abutting the lip 60 as can be seen in FIGS. 2 and 3. The first portion 92 may be cantilevered from the second portion 94, as shown in FIG. 3. The first portion 92 of the tray 90 may support snacks, candies or other food within easy reach of the user. The second planar portion 94 has an opening 96, which is adapted to receive an auxiliary item, such as for instance a cup with a drink or coins, or an ashtray, depending on the user's preference.

The first portion 92 extends at a substantially obtuse angle to the second portion 94. It is preferred that the first portion extend in a substantially parallel relationship to a support surface of the game machine, for instance a floor of a video game parlor, to prevent food items positioned on the first portion 92 from sliding off the tray 90. If desired, a small lip may be formed about the periphery of the first portion 92 to further ensure stable position of the food items on the tray 90.

The device 10 is made lightweight, relatively durable and inexpensive. The contact surfaces are preferably made smooth, without protrusions, pliant and allow the video machine owner to clean and sanitize the contact surfaces between uses. The device 10 may, however, be made of other or additional materials, including heavier materials, including bases made of molded plastic, acrylic, fiberglass, aluminum and other materials to add further stability and rigidity to the device 10 when positioned on the associated gaming machine 12.

Many changes and modifications may be made in the design of the arm support device in accordance with the present invention. I, therefore, pray that my rights to the present invention be limited only by the scope of the appended claims.

I claim:

1. An arm support device configured for mounting to a video same machine having a console, interactive controls and opposing side walls, the device comprising:

at least a planar first portion configured for removable resting on the console without blocking access to the interactive controls of the video same machine, said first planar portion having a pliant upper surface;

a second planar portion extending downwardly in relation to said console without b1ocking access to the interactive controls of the video game machine, said second planar portion being unitary connected to said at least first planar portion, and a food support tray carried by the peripheral lip of said at least first planar portion, said food tray having a first part secured to the peripheral lip of said at least first planar portion and a second part cantilevered from the first part.

2. The device of claim 1, wherein said second part of the food support tray is oriented to extend in a substantially parallel relationship to a support surface of the video game machine.

3. The device of claim 1, wherein said first part is provided with an opening for receiving an auxiliary item therein.

4. An arm support device configured for mounting to a video game machine having a console, interactive controls and opposing sidewalls, said device comprising:

a first planar portion configured for removable resting on the console without blocking access to the interactive controls of the video game machine, said first planar portion having a pliant upper surface;

a second planar portion extending downwardly in relation to said console without blocking access to the interactive controls of the video game machine, said second planar portion being unitary connected to said first planar portion and provided with pliant front surface; and a support tray secured to said first planar portion, said support tray being configured for supporting auxiliary items in immediate proximity to the video gaming machine.

5. The device of claim 4, further comprising a pair of opposing securing members secured to the second planar portion and extending transversely to the front surface and in a substantially parallel relationship to respective opposing side walls of the video game machine to facilitate secure positioning of the arm support device on the video game machine.

6. The device of claim 4, wherein said first portion is hingedly coupled to the second portion.

7. The device of claim 6, wherein the first planar portion comprises a peripheral lip extending about the periphery of the upper surface, said second planar portion comprises a peripheral lip extending about the periphery of the front surface, wherein a line of connection between the lip of the first planar portion and the lip of the second planar portion forms a hinge line.

8. The device of claim 4, wherein the support tray comprises a first part provided with an opening and a second part oriented to extend in a substantially parallel relationship to a support surface of the game video machine.

9. The device of claim 8, wherein said first part extends at a substantially obtuse angle in relation to the second part.

* * * * *